US007339560B2

(12) United States Patent
Sun

(10) Patent No.: US 7,339,560 B2
(45) Date of Patent: Mar. 4, 2008

(54) OLED PIXEL

(75) Inventor: Wein-Town Sun, Kaohsiung (TW)

(73) Assignee: Au Optronics Corporation, Hsinchu (TW)

( * ) Notice: Subject to any disclaimer, the term of this patent is extended or adjusted under 35 U.S.C. 154(b) by 702 days.

(21) Appl. No.: 10/776,177

(22) Filed: Feb. 12, 2004

(65) Prior Publication Data

US 2005/0179624 A1 Aug. 18, 2005

(51) Int. Cl.
*G09G 3/30* (2006.01)

(52) U.S. Cl. ..... 345/76; 345/82; 345/36

(58) Field of Classification Search ..... 345/76, 345/82, 36

See application file for complete search history.

(56) References Cited

U.S. PATENT DOCUMENTS

| | | | |
|---|---|---|---|
| 6,229,506 | B1 | 5/2001 | Dawson et al. |
| 6,373,454 | B1 | 4/2002 | Knapp et al. |
| 6,501,466 | B1 | 12/2002 | Yamagishi et al. |
| 2002/0135312 | A1 | 9/2002 | Koyama |
| 2002/0180369 | A1 | 12/2002 | Koyama |
| 2002/0195968 | A1 | 12/2002 | Sanford et al. |
| 2003/0030382 | A1 | 2/2003 | Koyama |
| 2003/0085665 | A1 | 5/2003 | Yoo |
| 2004/0056828 | A1* | 3/2004 | Choi et al. ..... 345/82 |

* cited by examiner

*Primary Examiner*—Richard Hjerpe
*Assistant Examiner*—Leonid Shapiro
(74) *Attorney, Agent, or Firm*—Thomas, Kayden, Horstemeyer & Risley

(57) ABSTRACT

A pixel device of an electroluminescence device that comprises a voltage signal having a first state and a second state, a current signal, a first circuit further comprising a first transistor, a second transistor and a capacitor, the capacitor including a first terminal coupled to a power supply, the first transistor including a gate electrode coupled to a second terminal of the capacitor, and the second transistor including a gate electrode receiving the voltage signal, wherein the first circuit provides a voltage level across the capacitor in response to the first state of the voltage signal, and maintains the voltage level in response to the second state of the voltage signal, and a second circuit further comprising a third transistor and a fourth transistor, the third transistor including a gate electrode coupled to a gate electrode of the fourth transistor, wherein the second circuit provides a current proportional to the magnitude of the current signal in response to the first state of the voltage signal, and the first circuit provides a sum current of the proportional current and the current signal.

23 Claims, 2 Drawing Sheets

OLED PIXEL

FIELD OF THE INVENTION

This invention relates in general to an electroluminescence device and, more particularly, to a pixel element of an organic electroluminescence device.

BACKGROUND OF THE INVENTION

An electroluminescence ("EL") device is a device which makes use of the phenomenon of electro luminescence to emit light. An EL device generally includes thin film transistors ("TFT") and a light-emitting diode ("LED") further including a light-emitting layer. If the light-emitting layer contains organic light-emitting material, the device is referred to as an organic EL device. When a current passes between a cathode and an anode of the LED device, light is emitted through the light-emitting layer.

Typically, EL devices may be classified into voltage-driven type and current-driven type. As compared to a current-driven EL device, a voltage-driven EL device may be disadvantageous in non-uniform pixel brightness caused by different threshold voltages and mobility of TFTs. Examples of current-driven EL devices are found in U.S. Pat. No. 6,373,454 to Knapp, entitled "Active Matrix Electroluminescence Devices, and U.S. Pat. No. 6,501,466 to Yamagishi, entitled "Active Matrix Type Display Apparatus and Drive Circuit Thereof."

For current-driven EL devices, pixel brightness is proportional to a current flowing through an LED. It is thus desirable to have an EL device that provides uniform and enhanced brightness.

SUMMARY OF THE INVENTION

To achieve these and other advantages, and in accordance with the purpose of the invention as embodied and broadly described, there is provided a pixel device of an electroluminescence device that comprises a voltage signal having a first state and a second state, a current signal, a first circuit further comprising a first transistor, a second transistor and a capacitor, the capacitor including a first terminal coupled to a power supply, the first transistor including a gate electrode coupled to a second terminal of the capacitor, and the second transistor including a gate electrode receiving the voltage signal, wherein the first circuit provides a voltage level across the capacitor in response to the first state of the voltage signal, and maintains the voltage level in response to the second state of the voltage signal, and a second circuit further comprising a third transistor and a fourth transistor, the third transistor including a gate electrode coupled to a gate electrode of the fourth transistor, wherein the second circuit provides a current proportional to the magnitude of the current signal in response to the first state of the voltage signal, and the first circuit provides a sum current of the proportional current and the current signal.

Also in accordance with the present invention, there is provided a pixel device of an electroluminescence device that comprises a voltage signal including a first state and a second state, a current signal of a magnitude I, a first circuit further comprising a first transistor, a second transistor and a capacitor providing a voltage level across the capacitor in response to the first state of the voltage signal, and maintaining the voltage level in response to the second state of the voltage signal, and a second circuit further comprising a third transistor and a fourth transistor, the third transistor including a channel width/length value N times a channel width/length value of the fourth transistor, wherein the first circuit provides a current of (1+1/N) I during the first and second states of the voltage signal, and the second circuit provides a current of 1/N I in response to the first state of the voltage signal.

Still in accordance with the present invention, there is provided an electroluminescence device that comprises a plurality of scan lines, a plurality of data lines, and an array of pixels, each of the pixels being disposed near an intersection of one of the scan lines and one of the data lines comprising a first circuit further comprising a first transistor, a second transistor and a capacitor, the capacitor including a first terminal coupled to a power supply, the first transistor including a gate electrode coupled to a second terminal of the capacitor, and the second transistor including a gate electrode receiving the voltage signal, a second circuit further comprising a third transistor and a fourth transistor, the third transistor including a gate electrode coupled to a gate electrode of the fourth transistor, and a fifth transistor further comprising a gate electrode receiving the voltage signal, and an electrode receiving a current signal provided over a corresponding data line.

Further still in accordance with the present invention, there is provided a method of operating an electroluminescence device that comprises providing a voltage signal having a first state and a second state, providing a current signal having a magnitude I, providing an array of pixels, each of the pixels being disposed near an intersection of one of scan lines and one of data lines, providing each of the pixels with a first circuit including a first transistor, a second transistor and a capacitor, providing a voltage level across the capacitor in response to the first state of the voltage signal provided over a corresponding scan line, maintaining the voltage level in response to the second state of the voltage signal, providing each of the pixels with a second circuit including a third transistor and a fourth transistor, the third transistor including a gate electrode coupled to a gate electrode of the fourth transistor, providing a first current of (1+1/N) I from the first circuit during the first and second states of the voltage signal, and providing a second current of (1/N) I from the second circuit in response to the first state of the voltage signal, N being the ratio of a channel width/length of the third transistor to that of the fourth transistor.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present embodiment of the invention, an example of which is illustrated in the accompanying drawings. Wherever possible, the same reference numbers will be used throughout the drawings to refer to the same or like parts.

Figure 1:
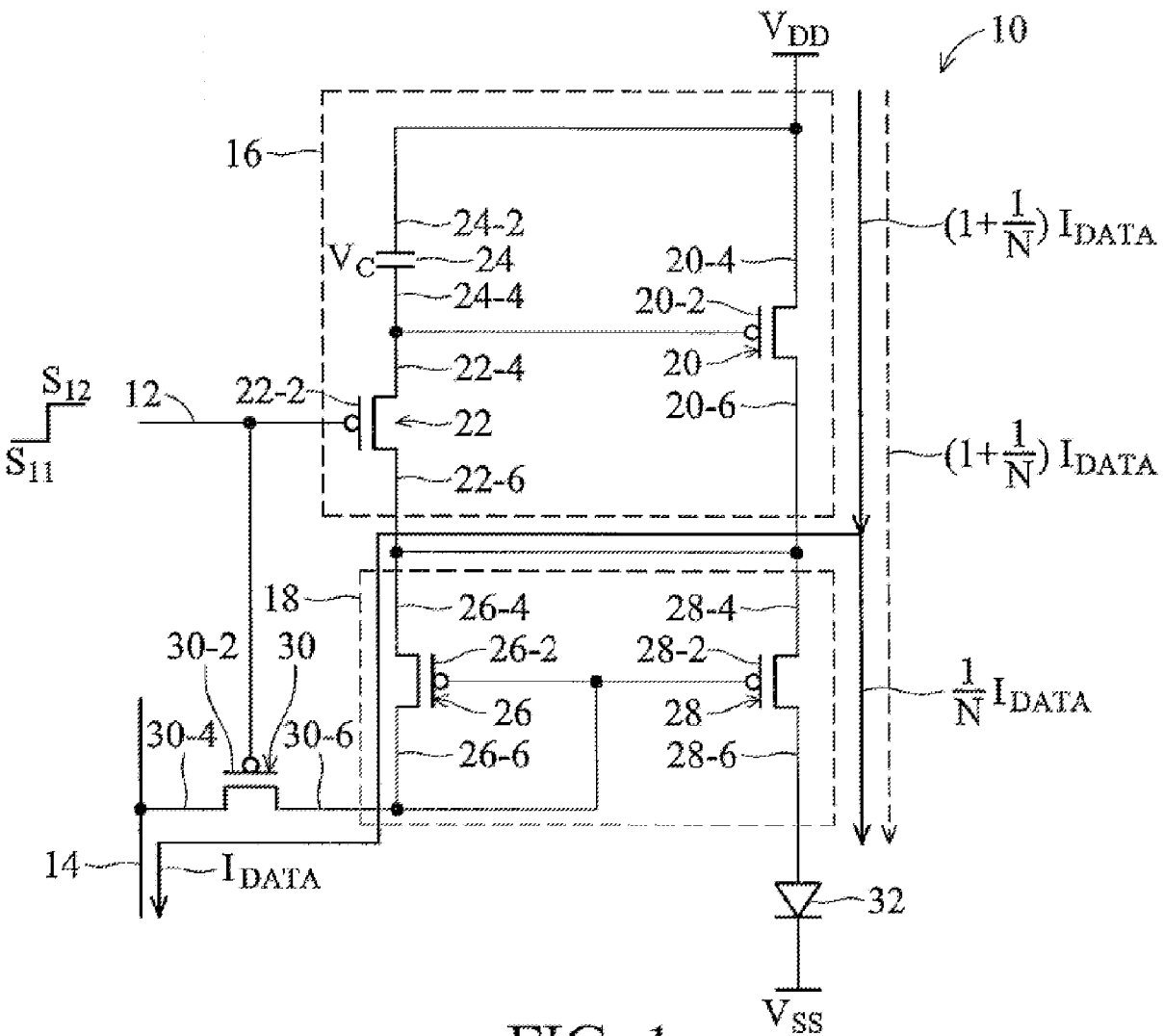
FIG. 1 is a circuit diagram of a pixel of an electroluminescence device in accordance with one embodiment of the present invention.

FIG. 1 is a circuit diagram of a pixel 10 of an electroluminescence ("EL") device in accordance with one embodiment of the present invention. The EL device consistent with the present invention includes a plurality of scan lines, a plurality of data lines, an array of pixels, a scan driver (not shown) sequentially providing a voltage signal having a first state $S_{11}$ and a second state $S_{12}$ to select the scan lines, and a data driver (not shown) sequentially providing a current signal $I_{DATA}$ to the data lines. In one embodiment according to the invention, the EL device includes an organic EL device, which may further include an organic light emitting diode ("OLED") or a polymer light emitting diode ("PLED"). A difference between an OLED and a PLED lies in the size of light emitting molecules used in a light emitting layer. The light emitting molecules of an OLED are smaller than those of a PLED.

Each of the pixels is disposed near an intersection of one of the scan lines and one of the data lines. Referring to FIG. 1, a representative pixel 10, disposed near a corresponding scan line 12 and a corresponding data line 14, includes a first circuit 16 and a second circuit 18. First circuit 16 further includes a first transistor 20, a second transistor 22, and a capacitor 24. First transistor 20 includes a gate electrode 20-2, a first electrode 20-4 coupled to a first power supply $V_{DD}$, and a second electrode 20-6. Second transistor 22 includes a gate electrode 22-2 coupled to scan line 12, a first electrode 22-4 coupled to gate electrode 20-2 of first transistor 20, and a second electrode 22-6 coupled to second electrode 20-6 of first transistor 20. Capacitor 24 includes a first terminal 24-2 coupled to $V_{DD}$, and a second terminal 24-4 coupled to gate electrode 20-2 of first transistor 20.

Second circuit 18 further includes a third transistor 26 and a fourth transistor 28. Third transistor 26 includes a gate electrode 26-2, a first electrode 26-4 coupled to second electrode 22-6 of second transistor 22, and a second electrode 26-6 coupled to gate electrode 26-2. Since gate electrode 26-2 and second electrode 26-6 are coupled to each other, third transistor 26 operates in a saturation mode. Fourth transistor 28 includes a gate electrode 28-2 coupled to gate electrode 26-2 of third transistor 26, a first electrode 28-4 coupled to second electrode 20-6 of first transistor 20, and a second electrode 28-6. The W/L ratio of third transistor 26 is N times the W/L ratio of fourth transistor 28, wherein W/L is a channel width/length of a field effect transistor. In one embodiment according to the invention, N ranges from approximately 1 to 10.

Pixel 10 further includes a fifth transistor 30 and a light emitting diode ("LED") 32. Fifth transistor 30 includes a gate electrode 30-2 coupled to scan line 12, a first electrode 30-4 coupled to data line 14, and a second electrode 30-6 coupled to second electrode 26-6 of third transistor 26. LED 32, including an OLED or a PLED, is disposed between second electrode 28-6 of fourth transistor 28 and a second power supply $V_{SS}$. In one embodiment according to the invention, LED 32 is disposed between first electrode 20-4 of first transistor 20 and $V_{DD}$, and second electrode 28-6 of second transistor 28 is coupled to $V_{SS}$.

During a write stage, or in response to the first state $S_{11}$ of the voltage signal provided over scan line 12, fifth transistor 30 and second transistor 22 are turned on. Current signal $I_{DATA}$ is provided over data line 14 to pixel 10. Third transistor 26, operating in a saturation mode, is turned on to provide a first current equal to $I_{DATA}$. Fourth transistor 28 is turned on because gate electrode 28-2 is biased at a same voltage level as gate electrode 26-2 of third transistor 26. Since second transistor 22 is turned on, capacitor 24 is charged by a drain current (not shown) of second transistor 22, providing a voltage level $V_C$ across capacitor 24 or across first electrode 20-4 and gate electrode 20-2, which turns on first transistor 20. As a result, a first current $I_{DATA}$ flows through first transistor 20, third transistor 26 and fifth transistor 30 to data line 14. A second current equal to 1/N $I_{DATA}$ flows through first transistor 20 and fourth transistor 28 to LED 32. Since a total of (1+1/N) $I_{DATA}$ current flows through first transistor 20, voltage level $V_C$ must satisfy the following equation.

$$(1+1/N)\ I_{DATA}=(\mu C_{OX}/2)(W/L)(|V_C|-|V_T|)^2$$

Where μ is the mobility of carriers, $C_{OX}$ is oxide capacitance, W/L is the channel width/length of first transistor 20, and $V_T$ is a threshold voltage of first transistor 20.

During a reproducing stage, or in response to the second state $S_{12}$ of the voltage signal, fifth transistor 30 and second transistor 22 are turned off. The voltage level across capacitor 24 during the write stage is maintained at $V_C$, which turns on first transistor 20. A third current (shown in a dotted line) equal to approximately (1+1/N) $I_{DATA}$ from first transistor 20 turns on fourth transistor 28 and flows to LED 32. In one embodiment according to the invention, first power supply $V_{DD}$ provides a voltage level ranging from approximately 7V (volts) to 9V, second power supply $V_{SS}$ provides a voltage level ranging from approximately −8V to −6V. The voltage signal ranges from approximately −6V to 8V. The current signal ranges from approximately 1 μA (microampere) to 2 μA.

In view of the above, in response to the first state $S_{11}$ of the voltage signal, first circuit 16 provides voltage level $V_C$ across capacitor 24, and second circuit 18 provides second current 1/N $I_{DATA}$ flowing thru LED 32. In response to the second state $S_{12}$ of the voltage signal, first circuit 16 maintains voltage level $V_C$, and provides third current (1+1/N) $I_{DATA}$ flowing thru LED 32.

In the particular embodiment of the EL device shown in FIG. 1, all the transistors 20, 22, 26, 28 and 30 are p-channel metal-oxide-semiconductor ("PMOS") transistors. In other embodiments, however, these transistors 20, 22, 26, 28 and 30 may include n-channel metal-oxide-semiconductor ("NMOS") transistors only if second and fifth transistors 22 and 30 are of a same conductive type and third and fourth transistors 26 and 28 are of a same conductive type.

Figure 2:
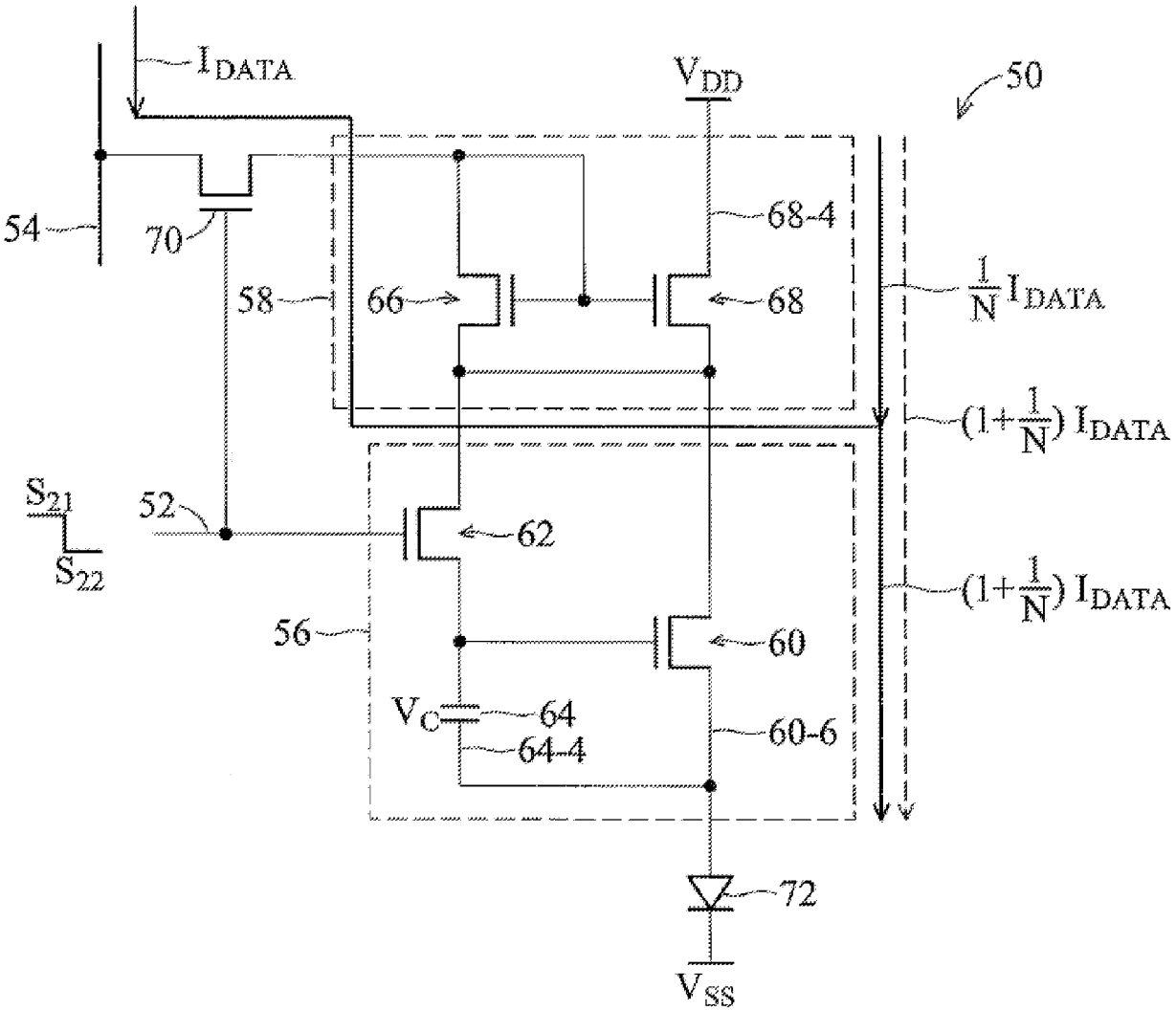
FIG. 2 is a circuit diagram of a pixel of an electroluminescence device in accordance with another embodiment of the present invention.

FIG. 2 is a circuit diagram of a pixel 50 of an electroluminescence ("EL") device in accordance with another embodiment of the present invention. Pixel 50 has a similar circuit structure to pixel 10 shown in FIG. 1 except that transistors are NMOS transistors. Pixel 50 includes a first circuit 56 and a second circuit 58. First circuit 56 further comprises a first transistor 60, a second transistor 62, and a capacitor 64. Second circuit 58 further comprises a third transistor 66 and a fourth transistor 68. Pixel 50 further comprises a fifth transistor 70 and an LED 72. In response to a first state $S_{21}$ of a voltage signal provided over a scan line 52, first circuit 56 provides a voltage level $V_C$ across capacitor 64, resulting in a first current $I_{DATA}$ flowing from a data line 54 through transistors 70, 66 and 60, and second circuit 58 provides a second current 1/N $I_{DATA}$ flowing thru LED 72. In response to a second state $S_{22}$ of the voltage signal, first circuit 56 maintains voltage level $V_C$, and provides a third current (1+1/N) $I_{DATA}$ flowing thru LED 72.

In the particular embodiment of the EL device shown in FIG. 2, LED 72 is coupled between a second terminal 64-4 of capacitor 64 and a second power supply $V_{SS}$. In one embodiment according to the invention, LED 72 is coupled between a first power supply $V_{DD}$ and a first electrode 68-4 of fourth transistor 68. In another embodiment, LED 72 is coupled between a second terminal 64-4 of capacitor 64 and a second electrode 60-6 of first transistor 60.

The present invention also provides a method of operating an electroluminescence device. A voltage signal having a first state $S_{11}$ and a second state $S_{12}$ is provided. A current signal having a magnitude I is provided. An array of pixels 10 is provided. Each of pixels 10 is disposed near an intersection of one of scan lines 12 and one of data lines 14. Each of pixels 10 is provided with a first circuit 16 including a first transistor 20, a second transistor 22 and a capacitor 24. A voltage level $V_C$ across capacitor 24 is provided in response to the first state $S_{11}$ of the voltage signal provided over a corresponding scan line 12. Voltage level $V_C$ is maintained in response to the second state $S_{12}$ of the voltage signal. Each of pixels 10 is provided with a second circuit 18 including a third transistor 26 and a fourth transistor 28. Third transistor 26 includes a gate electrode 26-2 coupled gate electrode 28-2 of fourth transistor 28. A first current of (1+1/N) I is provided from first circuit 16 during the second states $S_{12}$ of the voltage signal. A second current of (1/N) I is provided from second circuit 18 in response to the first state $S_{11}$ of the voltage signal, N being the ratio of a channel width/length of third transistor 26 to that of fourth transistor 28.

The method further comprises providing a fifth transistor 30 including a gate electrode 30-2 receiving the voltage signal, and an electrode 30-4 receiving the current signal. The method further comprises providing a light emitting diode 32. In one embodiment according to the present invention, first current of (1+1/N) I is provided during the first state of the voltage signal. In another embodiment, first current of (1+1/N) I is provided during the second state of the voltage signal. In still another embodiment, second current of (1/N) I is provided during the first state of the voltage signal. In yet still another embodiment, second current of (1+1/N) I is provided during the second state of the voltage signal.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A pixel device of an electroluminescence device comprising:

a voltage signal having a first state and a second state;

a current signal;

a first circuit further comprising a first transistor, a second transistor and a capacitor, the capacitor including a first terminal coupled to a power supply, the first transistor including a gate electrode coupled to a second terminal of the capacitor, and the second transistor including a gate electrode receiving the voltage signal, wherein the first circuit provides a voltage level across the capacitor in response to the first state of the voltage signal, and maintains the voltage level in response to the second state of the voltage signal; and a second circuit further comprising a third transistor and a fourth transistor, the third transistor including a gate electrode coupled to a gate electrode of the fourth transistor;

wherein the second circuit provides a current proportional to the magnitude of the current signal in response to the first state of the voltage signal, and the first circuit provides a sum current of the proportional current and the current signal.

2. The device of claim 1, the third transistor having a channel width/length value N times a channel width/length value of the fourth transistor.

3. The device of claim 1, the magnitude of the current signal being N times the magnitude of the proportional current.

4. The device of claim 1, the voltage level satisfying an equation:

$$(1+1/N)\ I=(\mu C_{OX}/2)\ (W/L)\ (|V_C|-|V_T|)^2$$

where μ is the mobility of carriers, $C_{OX}$ is oxide capacitance, W/L is the channel width/length of the first transistor, $V_C$ is the voltage level and $V_T$ is a threshold voltage of the first transistor.

5. The device of claim 1 further comprising a fifth transistor including a gate electrode receiving the voltage signal, and an electrode receiving the current signal.

6. The device of claim 1, the third and fourth transistors are of a same conductive type.

7. The device of claim 5, the second and fifth transistors are of a same conductive type.

8. The device of claim 1 further comprising a light emitting diode disposed between an electrode of the fourth transistor and the power supply.

9. The device of claim 1 further comprising a light emitting diode disposed between an electrode of the fourth transistor and a different power supply.

10. The device of claim 1 further comprising a light emitting diode disposed between an electrode of the first transistor and the first terminal of the capacitor.

11. A pixel device of an electroluminescence device comprising:

a voltage signal having a first state and a second state;

a current signal of a magnitude I;

a first circuit further comprising a first transistor, a second transistor and a capacitor providing a voltage level across the capacitor in response to the first state of the voltage signal, and maintaining the voltage level in response to the second state of the voltage signal; and a second circuit further comprising a third transistor and a fourth transistor, the third transistor including a channel width/length value N times a channel width/length value of the fourth transistor;

wherein the first circuit provides a current of (1+1/N) I during the first and second states of the voltage signal, and the second circuit provides a current of 1/N I in response to the first state of the voltage signal.

12. The device of claim 11, the voltage level satisfying an equation:

$$(1+1/N)\ I=(\mu C_{OX}/2)\ (W/L)\ (|V_C|-|V_T|)^2$$

where μ is the mobility of carriers, $C_{OX}$ is oxide capacitance, W/L is the channel width/length of the first transistor, $V_C$ is the voltage level and $V_T$ is a threshold voltage of the first transistor.

13. The device of claim 11, the capacitor further comprising a first terminal coupled to a first power supply, and the first transistor further comprising a gate electrode coupled to a second terminal of the capacitor and a first electrode coupled to the first power supply.

14. The device of claim 11, the second transistor further comprising a gate electrode receiving the voltage signal, and a first electrode coupled to the second terminal of the capacitor.

15. The device of claim 11, the third transistor further comprising a gate electrode and an electrode coupled to the gate electrode, and the fourth transistor further comprising a gate electrode coupled to the gate electrode of the third transistor.

16. The device of claim 11 further comprising a fifth transistor including a gate electrode receiving the voltage signal, and an electrode receiving the current signal.

17. An electroluminescence device comprising:

a plurality of scan lines;

a plurality of data lines; and an array of pixels, each of the pixels being disposed near an intersection of one of the scan lines and one of the data lines comprising:

a first circuit further comprising a first transistor, a second transistor and a capacitor, the capacitor including a first terminal coupled to a power supply, the first transistor including a gate electrode coupled to a second terminal of the capacitor, and the second transistor including a gate electrode receiving a voltage signal;

a second circuit further comprising a third transistor and a fourth transistor, the third transistor including a gate electrode coupled to a gate electrode of the fourth transistor; and a fifth transistor further comprising a gate electrode receiving the voltage signal, and an electrode receiving a current signal provided over a corresponding data line;

wherein the current signal has a magnitude I, the first circuit providing a first current of (1+1/N) I during the first and second states of the voltage signal, and the second circuit providing a second current of (1/N) I in response to the first state of the voltage signal, N being the ratio of a channel width/length of the third transistor to that of the fourth transistor.

18. The device of claim 17, the first circuit providing a voltage level across the capacitor in response to a first state of a voltage signal provided over a corresponding scan line, and maintaining the voltage level in response to a second state of the voltage signal.

19. A pixel device of an electroluminescence device comprising:

providing a voltage signal having a first state and a second state;

providing a current signal having a magnitude I;

providing an array of pixels, each of the pixels being disposed near an intersection of one of scan lines and one of data lines;

providing each of the pixels with a first circuit including a first transistor, a second transistor and a capacitor;

providing a voltage level across the capacitor in response to the first state of the voltage signal provided over a corresponding scan line;

maintaining the voltage level in response to the second state of the voltage signal;

providing each of the pixels with a second circuit including a third transistor and a fourth transistor, the third transistor including a gate electrode coupled to a gate electrode of the fourth transistor;

providing a first current of (1+1/N) I from the first circuit during the first and second states of the voltage signal; and providing a second current of (1/N) I from the second circuit in response to the first state of the voltage signal, N being the ratio of a channel width/length of the third transistor to that of the fourth transistor.

20. The method of claim 19 further comprising providing the first current to a light emitting diode during the first state of the voltage signal.

21. The method of claim 19 further comprising providing the second current to a light emitting diode during the first state of the voltage signal.

22. The method of claim 19 further comprising providing the first current to a light emitting diode during the second state of the voltage signal.

23. The method of claim 19 further comprising providing the second current to a light emitting diode during the second state of the voltage signal.

* * * * *